US010422115B2

(12) United States Patent
Chong et al.

(10) Patent No.: US 10,422,115 B2
(45) Date of Patent: Sep. 24, 2019

(54) SINK AND METHOD OF MOUNTING

(71) Applicant: Elkay Manufacturing Company, Oak Brook, IL (US)

(72) Inventors: Jonathan Chee Yeen Chong, Chicago, IL (US); Erik Lynch, Downers Grove, IL (US); Macrina Sanchez, Chicago, IL (US); Nick Nanos, Lake in the Hills, IL (US); Robert Foley, Naperville, IL (US)

(73) Assignee: Elkay Manufacturing Company, Oak Brook, IL (US)

( * ) Notice: Subject to any disclaimer, the term of this patent is extended or adjusted under 35 U.S.C. 154(b) by 0 days.

(21) Appl. No.: 15/399,437

(22) Filed: Jan. 5, 2017

(65) Prior Publication Data

US 2018/0187402 A1 Jul. 5, 2018

(51) Int. Cl.
*E03C 1/33* (2006.01)

(52) U.S. Cl.
CPC ..... *E03C 1/33* (2013.01)

(58) Field of Classification Search
CPC ..... E03C 1/186
USPC ..... 4/619, 654–659
See application file for complete search history.

(56) References Cited

U.S. PATENT DOCUMENTS 1,453,945 A * 5/1923 Peterson ..... E03C 1/18 4/637
2,459,702 A 10/1948 Watts
D353,652 S 12/1994 Dannenberg
5,551,103 A 9/1996 Drozdowich et al.
5,743,501 A * 4/1998 Rapp ..... E03C 1/33 248/200.1
5,864,898 A 2/1999 Knapp et al.
5,940,906 A 8/1999 Halloran
6,108,831 A 8/2000 Lombreglia, Jr.
D560,773 S 1/2008 Kitzmiller
7,377,661 B2 5/2008 Douglass
D651,699 S 1/2012 Booth et al.
D655,798 S 3/2012 Miller et al.
(Continued)

FOREIGN PATENT DOCUMENTS

DE 10 2008 049 794 A1 4/2010

OTHER PUBLICATIONS

"Kitchen Sinks: Farmhouse Sink with Stainless Steel Backsplash," Just Manufacturing, http://www.justsinks.com/farmhouse-sink-w-backsplash/ (Nov. 8, 2016).
(Continued)

*Primary Examiner* — Lori L Baker
(74) *Attorney, Agent, or Firm* — Leydig, Voit & Mayer, Ltd.

(57) ABSTRACT

An undermount sink and countertop combination for use with a sink cabinet. The sink cabinet includes a sink-receiving opening and a sink cabinet width and depth. The sink includes a basin that is sized and shaped to be received within the sink-receiving opening. The basin includes side wall portions, an upper outer perimeter surrounding the side wall portions, and a bottom portion. A mounting flange extends from the upper outer perimeter of the basin. The mounting flange is shaped to rest atop the cabinet and underneath the countertop and is sized with a mounting flange width and depth substantially equal to the sink cabinet width and depth.

15 Claims, 10 Drawing Sheets

(56) References Cited

U.S. PATENT DOCUMENTS

| | | | | |
|---|---|---|---|---|
| D662,574 | S | 6/2012 | Booth et al. | |
| D663,389 | S | 7/2012 | Miller et al. | |
| D663,395 | S | 7/2012 | Miller et al. | |
| D670,364 | S | 11/2012 | Miller et al. | |
| D670,366 | S | 11/2012 | Booth et al. | |
| D670,367 | S | 11/2012 | Miller et al. | |
| D671,197 | S | 11/2012 | Miller et al. | |
| D675,300 | S | 1/2013 | Miller et al. | |
| 8,418,281 | B2 * | 4/2013 | Sutter | E03C 1/33 4/619 |
| 8,661,577 | B2 | 3/2014 | Cusimano | |
| 8,844,070 | B2 * | 9/2014 | Booth | A47B 77/06 4/631 |
| 9,115,484 | B2 * | 8/2015 | Fulford | E03C 1/186 |
| 9,173,487 | B2 | 11/2015 | Booth et al. | |
| 9,486,113 | B2 | 11/2016 | Zimbric | |
| 9,492,010 | B2 | 11/2016 | Booth et al. | |
| 9,492,011 | B2 | 11/2016 | Booth et al. | |
| 9,708,802 | B2 * | 7/2017 | Gibson | E03C 1/057 |
| 2009/0314730 | A1 * | 12/2009 | Mansikkamaa | A47K 10/08 211/113 |
| 2010/0275367 | A1 * | 11/2010 | Bager | A46B 17/02 4/628 |
| 2012/0124737 | A1 * | 5/2012 | Gibson | E03C 1/048 4/643 |
| 2014/0352054 | A1 * | 12/2014 | Tollasepp | A47J 47/20 4/654 |
| 2015/0059084 | A1 | 3/2015 | Hocaoglu | |
| 2015/0230667 | A1 * | 8/2015 | Palazzolo | E03C 1/186 4/654 |
| 2017/0247868 | A1 * | 8/2017 | Provencher | E03C 1/335 |
| 2018/0038084 | A1 * | 2/2018 | Blake | E03C 1/057 |
| 2018/0044901 | A1 * | 2/2018 | Lloyd | E03C 1/335 |
| 2018/0119397 | A1 * | 5/2018 | Gibson | E03C 1/33 |

OTHER PUBLICATIONS

"30" Baldwin Fireclay Farmhouse Sink-Fluted Apron-White, http://www.signaturehardware.com/kitchen/kitchen-sinks/farmhouse-sinks/30-baldwin-fireclay-farmhouse-sink-fluted-front-white.html (2016).

"Kohler K 3935 4 NA Vault 30" Single Basin Top Mount 18 Gauge Stainless Steel Kitchen Sink with Self Trimming, Item #: bci1867766 http://www.faucetdirect.com/kohler-k-3935-4-vault-30-single-basin-top-mount-18-gauge-stainless-steel-kitchen-sink-with-self-trimming/p1867766?gclid CKut9WWmtACFQ-DaQedGm4N-Q&source gg-gba-pta 1867766 407879356723&s kwicd=AL!3775l3l407879367 23lllgl.156757295123! (2016).

* cited by examiner

SINK AND METHOD OF MOUNTING

FIELD

This patent disclosure related generally to sinks and, more particularly, to undermount sinks and a method of mounting such sinks.

BACKGROUND

Kitchen sinks may be mounted employing an undermount design, wherein clips are used to secure outer flanges of the sink to the underside of a surrounding countertop material. In such a configuration, parts of the sink, except a faucet and faucet controls, remain below the surface of the countertop. To attach the sink to the underside of the countertop, holes are typically formed in the countertop material and an anchor or other attachment device is installed into the hole. The sink is typically attached to the anchor or attachment device with a fastener and clip or bracket. Accordingly, there is a significant amount of hardware and labor involved in attaching a sink to a cabinet in this fashion.

In connection with many tasks related to the use of sinks, it is common to have various items such as soap, rags, drain stoppers, etc., disposed in and around the sink. Typically, these items rest in an unorganized manner near the sink or in the sink basin and may be inconvenient to the sink user. Further, storing or otherwise placing soiled items in areas outside the sink is aesthetically displeasing and can soil those areas.

SUMMARY

In an embodiment, the disclosure describes an undermount sink and countertop combination for use with a sink cabinet. The sink cabinet includes a sink-receiving opening and a sink cabinet width and depth. The sink includes a basin that is sized and shaped to be received within the sink-receiving opening. The basin includes side wall portions, an upper outer perimeter surrounding the side wall portions, and a bottom portion. A mounting flange extends from the upper outer perimeter of the basin. The mounting flange is shaped to rest atop the cabinet and underneath the countertop and is sized with a mounting flange width and depth substantially equal to the sink cabinet width and depth.

In another embodiment, the disclosure describes a method of mounting an undermount sink to a sink cabinet. The method includes applying a first amount of adhesive to one or both of the sink cabinet and a lower flange surface of a mounting flange of the undermount sink. The mounting flange is set atop the sink cabinet and the first amount of adhesive secures the sink to the sink cabinet. A second amount of adhesive is applied to one or both of an upper flange surface of the mounting flange and a countertop. The countertop is set atop the mounting flange in contact with the second amount of adhesive to secure the sink in position.

DETAILED DESCRIPTION

Figure 1:
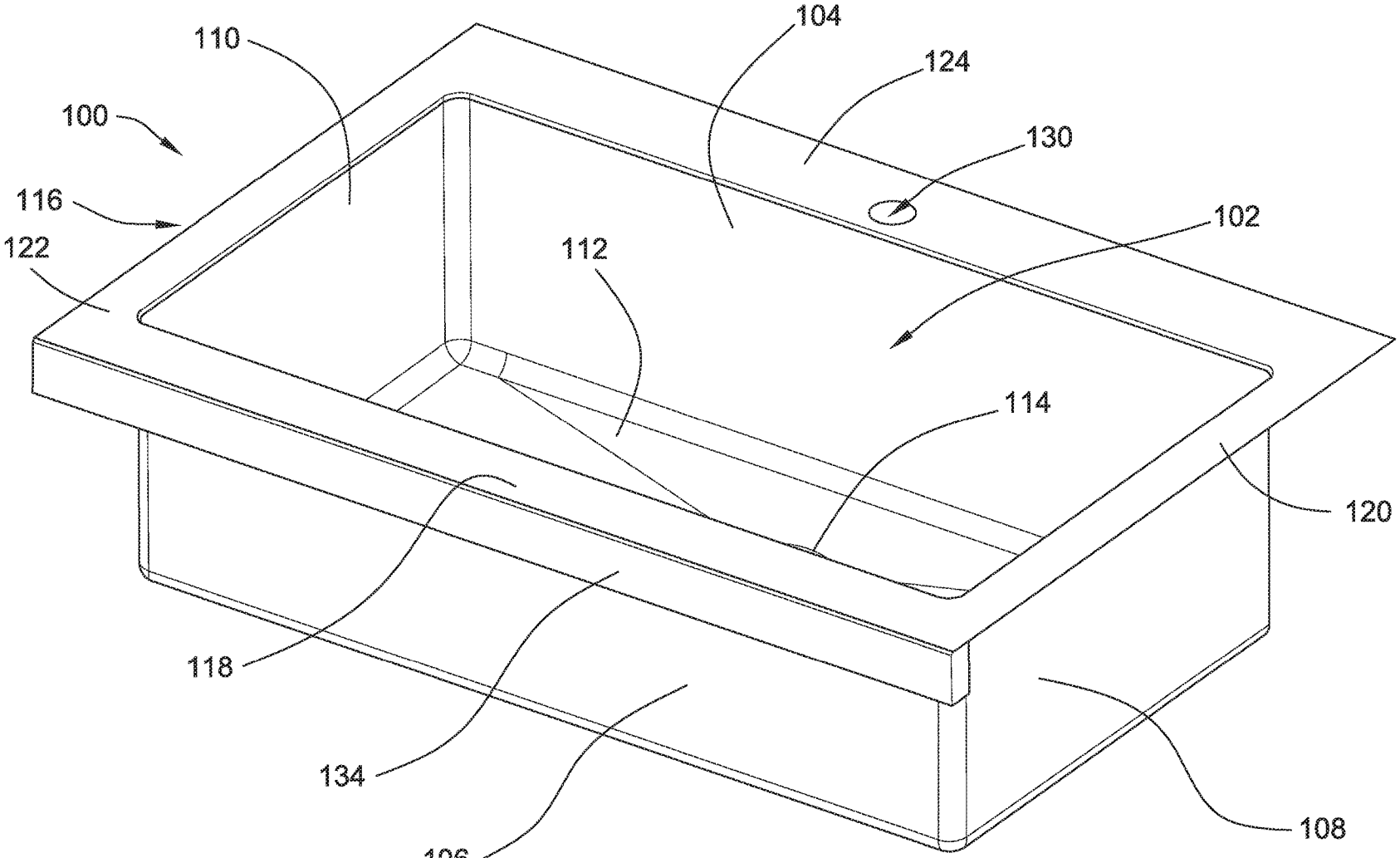
FIG. 1 is a perspective view of a sink according to an embodiment of the disclosure.
Figure 2:
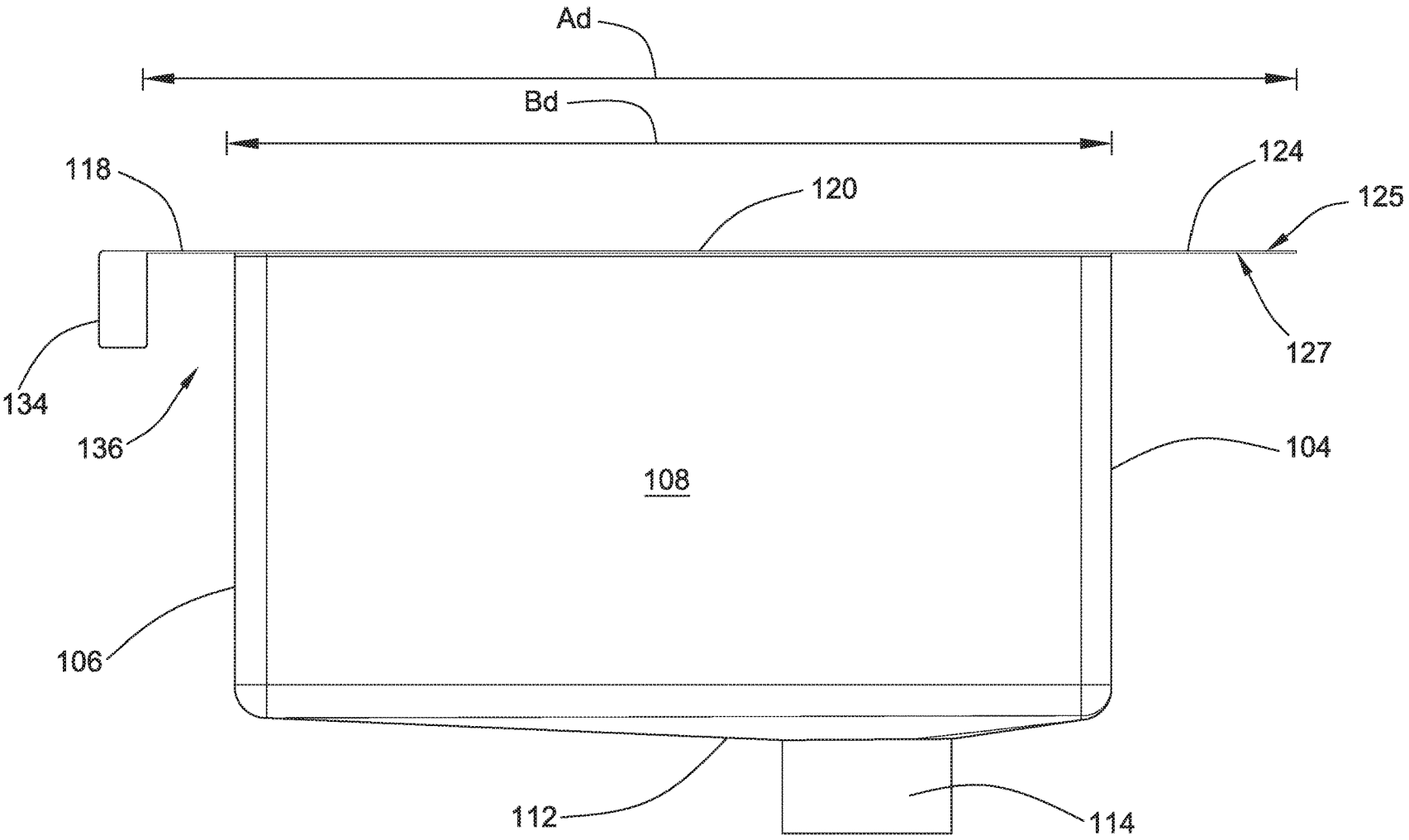
FIG. 2 is a side view of the sink according to the embodiment of FIG. 1.
Figure 3:
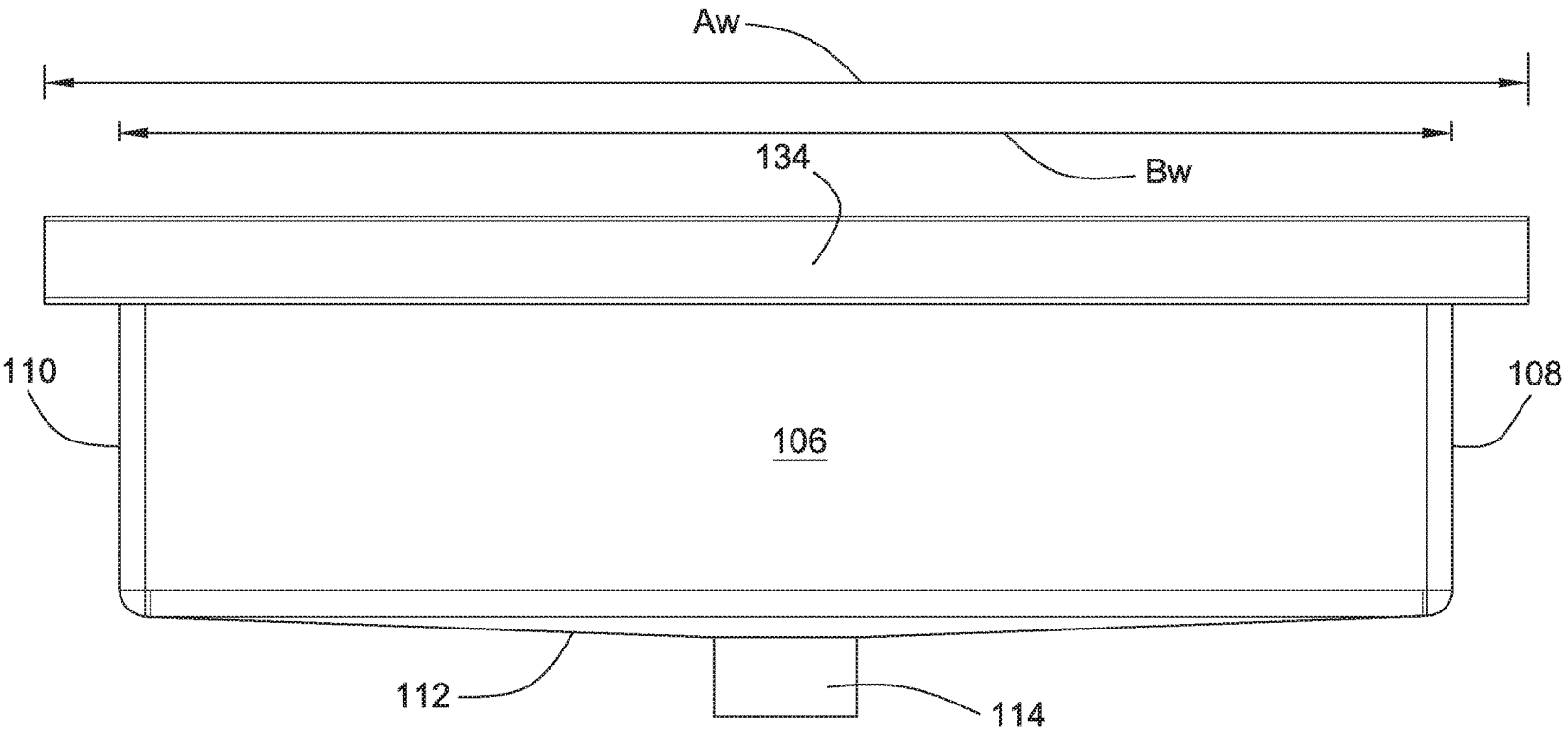
FIG. 3 is a front view of the sink according to the embodiment of FIG. 1.

Referring to FIGS. 1-3, an installed undermount sink 100 is shown according to an embodiment of the disclosure. The sink 100 may be of any suitable material. The material of the sink 100 may be stainless steel, for example, for its strength, durability, and modern appearance. The sink 100 may be formed as a single piece construction using any appropriate manufacturing method such as fabrication, drawing, welding, molding, pressing and the like. In one embodiment, the sink 100 is formed from a single piece of material, e.g. a single sheet of stainless steel, or in another embodiment, from several pieces of permanently joined material.

The sink 100 includes a basin 102. The basin 102 is sized and shaped to perform typical kitchen duties therewithin, such as retaining wash water, items to be washed, and so on. The basin 102 may include a back wall portion 104, a front wall portion 106, a right side wall portion 108 and a left side wall portion 110. The back wall portion 104, a front wall portion 106, a right side wall portion 108 and a left side wall portion 110 in combination define an upper outer perimeter of the basin 102.

The back wall portion 104, front wall portion 106, and the right and left side wall portions 108, 110 may be planar, curved or combinations of flat and curved shapes as is well known. Although the sink 100 illustrated in FIG. 1 includes one rectangular sink basin 102, other sink configurations including more than one sink basin having other shapes are also contemplated herein.

The basin 102 also includes a bottom portion 112 that extends to all of the side wall portions 104, 106, 108, 110 and closes the basin 102. The bottom portion 112 is shaped to drain to a drain opening 114, typically formed in a lowermost elevational position within the basin 102.

The sink 100 includes a rim or mounting flange 116 that may extend from and surround the basin 102 at or near an uppermost elevational rim position, i.e., the upper outer perimeter of the basin. The mounting flange 116 may fully peripherally surround the basin 102 or partially surround the basin. The mounting flange 116 extends substantially horizontally in a plane from the basin 102 and is sized and shaped to overlap with and be supported by structural members of a cabinet on and/or in which it is received. The details of the structural relationship of the mounting flange 116 and cabinet are set out in detail in FIGS. 5-7 and described hereinbelow.

The mounting flange 116 includes a front mounting flange portion 118, a right side mounting flange portion 120, and a left side mounting flange portion 122. The mounting flange 116 may also include a rear mounting flange portion 124, which in the illustrated embodiment also forms the faucet deck. The mounting flange 116 may extend horizontally outwardly about ¾ inches or more from the side wall portions 104, 106, 108, 110. The mounting flange 116 is sized and shaped to be received and rest atop the structural panels of a cabinet in which it is installed as will be described in detail hereinbelow (see FIGS. 5-7). The rear mounting flange portion 124 or faucet deck may include one or more opening 130 for a faucet 132 or a set of controls (see FIG. 4). The mounting flange 116 includes an upper flange surface 125 and a lower flange surface 127.

The sink 100 may include an apron 134. The apron 134 depends from edge of the front mounting flange portion 118 and defines a space 136 (see FIG. 2) between the apron and the front wall portion 106 of the basin 102. The space 136 may be rectangular or square, for example, and sized and shaped to receive a cabinet rail or part of a front cabinet panel, as will be described in detail hereinbelow (see FIG. 7).

Referring to FIG. 2, the sink 100 has a basin depth Bd, measured front-to-back that defines the maximum depth of the basin 102. The sink 100 has a mounting flange depth Ad, measured from the rear mounting flange portion 124 back to the apron 134 that defines the maximum depth of the mounting flange 116. Referring to FIG. 3, the sink 100 has a mounting flange width Aw, measured side-to-side that defines the maximum width of the mounting flange 116. The basin 102 has a basin width Bw, measured side-to-side that defines the maximum width of the basin. In the illustrated embodiment, the apron 134 has a width equal to Aw.

Figure 4:
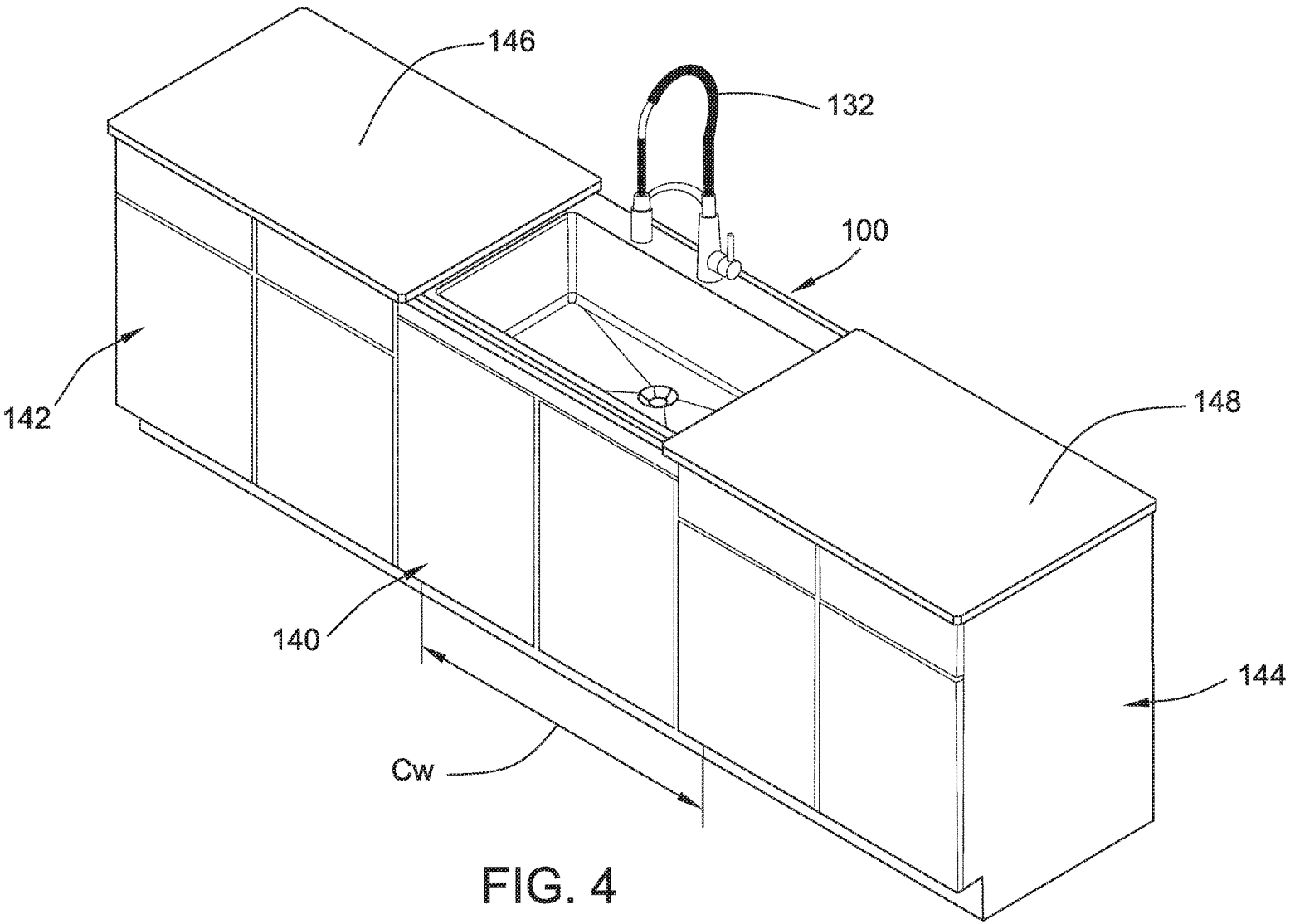
FIG. 4 is a perspective view of a set of cabinets, a clipless undermount sink according to the embodiment of sink of FIG. 1 installed to a central one of the set of cabinets, and countertops.
Figure 5:
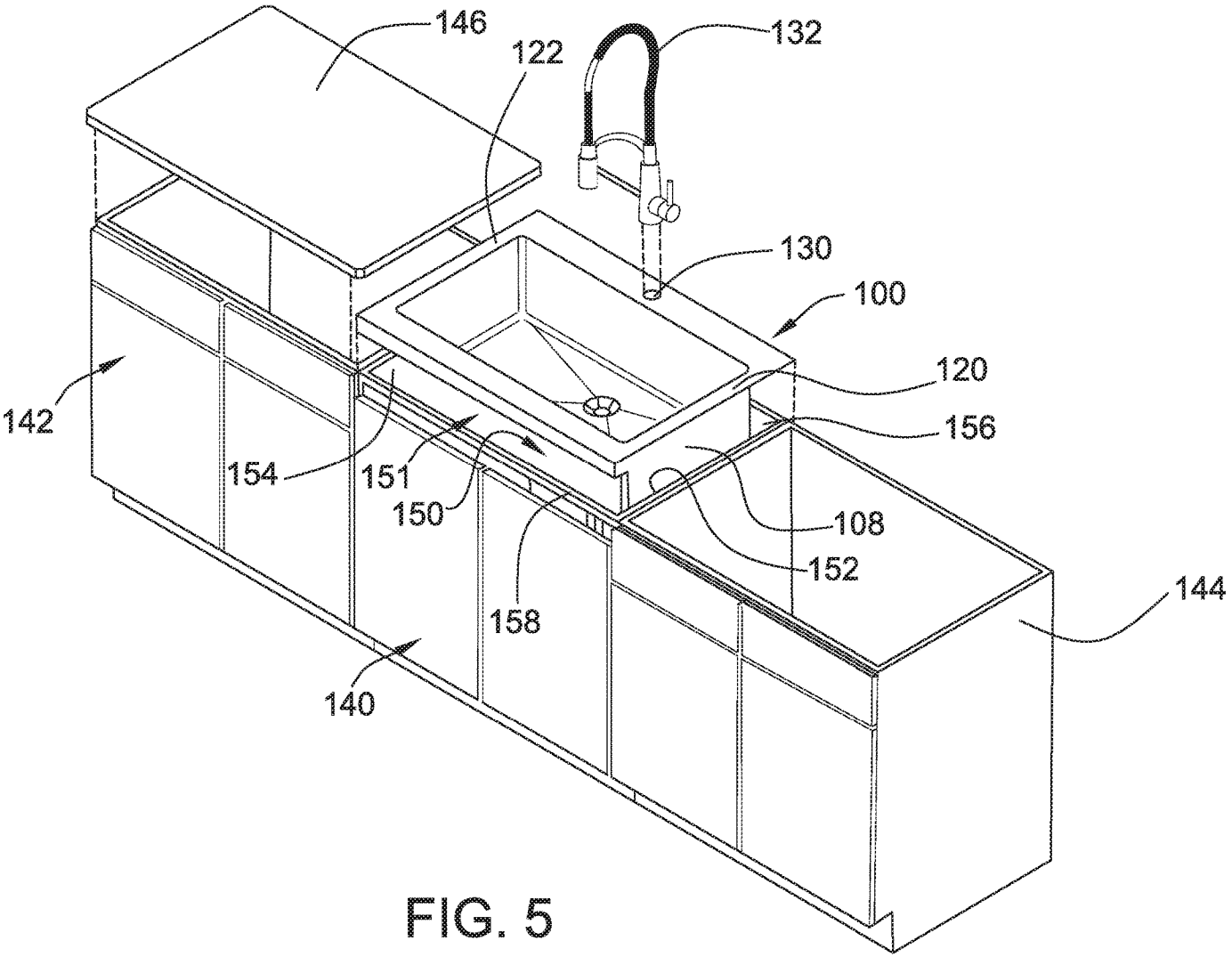
FIG. 5 is an exploded perspective view of the cabinets, sink, and countertops of FIG. 1.
Figure 6:
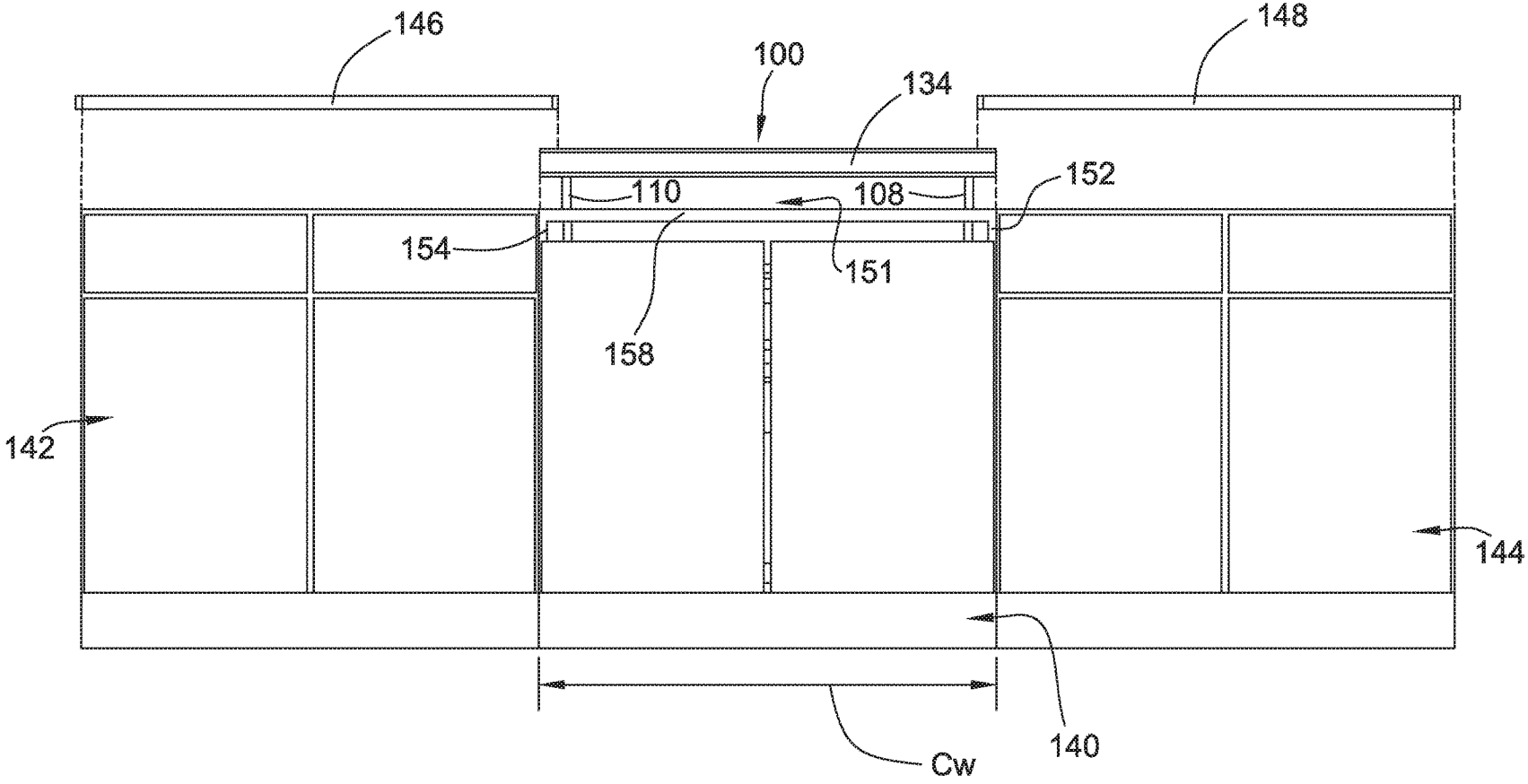
FIG. 6 is an exploded front view of the cabinets, sink and countertops of FIG. 4.

Turning to FIGS. 4-6, the sink 100 is sized and shaped to be received by and installed into a cabinet 140. The cabinet 140 has a cabinet width Cw that defines the maximum side-to-side outermost width of the cabinet. The cabinet width Cw, in one embodiment, is equal to the width Aw of the apron 134.

FIG. 4 shows the sink 100 in an installed state in cabinet 140. Cabinet 140 may be flanked by a first side cabinet 142 and a second side cabinet 144 opposite the first side cabinet. The first side cabinet 142 includes a first side cabinet countertop 146 disposed atop the first side cabinet and overlapping the left side mounting flange portion 122. The second side cabinet 144 includes a second side cabinet countertop 148 and overlapping the right side mounting flange portion 120 (see FIG. 6).

Referring to FIG. 5, the cabinet 140 may be of conventional construction. The cabinet 140 may generally be formed of four elements that at least in part define a rectangular or some interior space 150 with a defined width and depth and a sink-receiving opening 151. In particular, the cabinet 140 may include a right side panel 152, a left side panel 154, and a rear panel 156. Because cabinets typically include front doors, front drawers and the like, for accessing plumbing within the cabinet and/or access to storage within the cabinet, the front of the cabinet 140 may include a cross member 158 at the top thereof to complete the rectangular configuration. The interior space 150 is sized and shaped to receive the basin 102 therewithin. The basin 102 may be sized and shaped to substantially fill the sink-receiving opening 151, wherein substantially means in this context, that the basin fits into the sink-receiving opening with only a clearance such that the sidewalls of the basin are disposed closed to the cabinet walls to maximize the footprint of the basing to match that of the cabinet and thus maximize a space within the basin.

Figure 7:
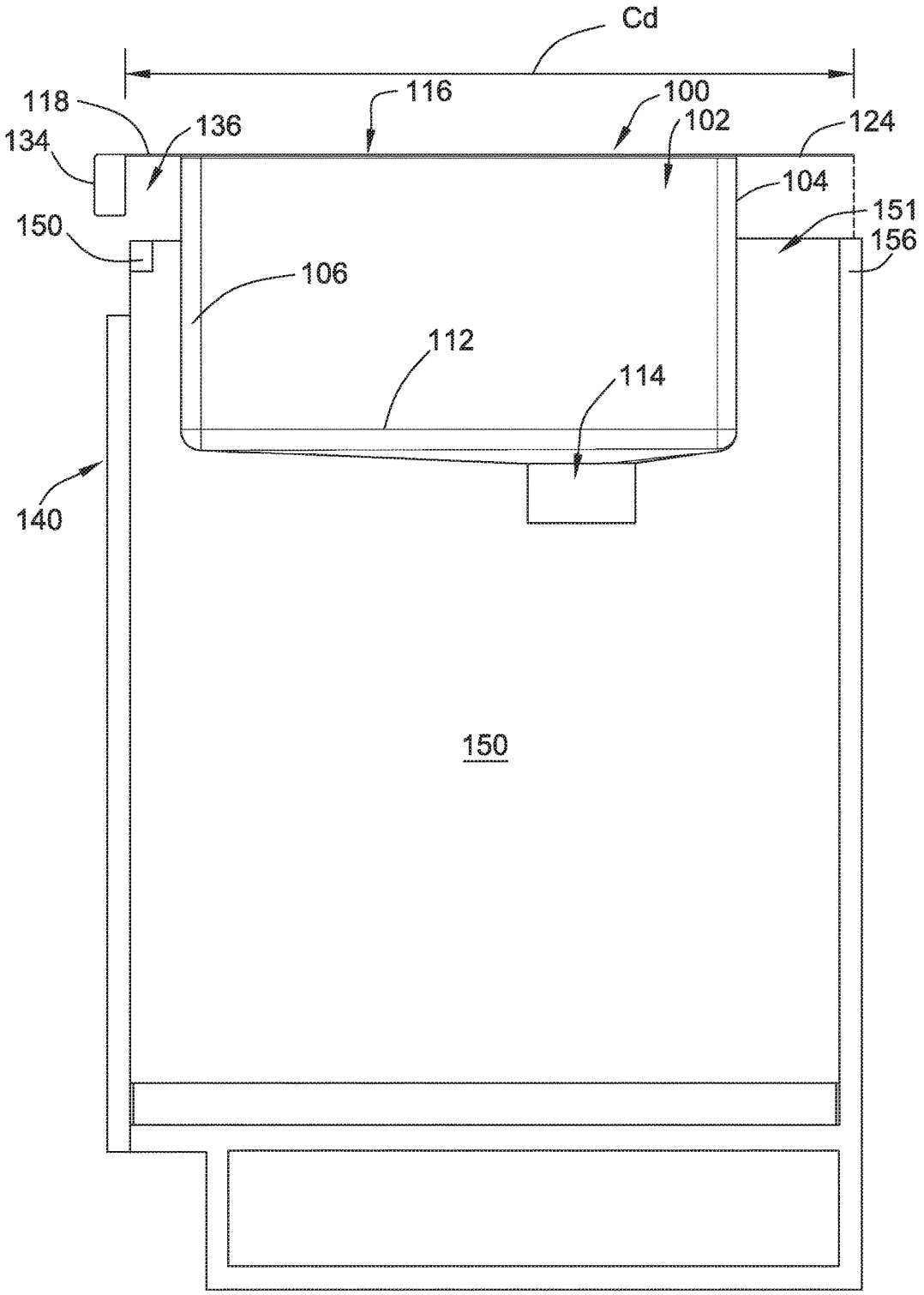
FIG. 7 is an exploded side section view of the sink and central cabinet of FIG. 4.

FIGS. 5, 6, and 7 show how the sink 100 fits and is assembled into the cabinet 140. The sink basin 102 is sized and shaped to fit within sink-receiving opening 151 and interior space 150. The right side mounting flange portion 120 of the sink 100 fits atop the right side panel 152 on an upper surface thereof. The left side mounting flange portion 122 of the sink 100 fits atop the left side panel 154 on an upper surface thereof. The front mounting flange portion 118 fits atop the cross member 158. The sink cabinet depth Cd of the cabinet 140 is equaled by the flange depth Ad (see FIG. 2). In one embodiment, the flange depth Ad is substantially equal to the sink cabinet depth Cd and the flange width Aw is substantially equal to sink cabinet width Cw. Substantially, in this context, means that the flange elements 118, 120, 122, 124 fit atop structural members, panels and members 152, 154, 156, 158 of the cabinet 140 to the extent that the sink 100 is sufficiently supported thereby.

In an embodiment, the rear mounting flange portion fits atop the rear panel 156. In an embodiment, the sink basin 102 is sized and shaped Bw, Bd to occupy the entire width and depth of the interior space 150 of the cabinet 140. The apron 134 has a width Aw that is the same as the cabinet width Cw. The sink space 134 is shaped and sized to accommodate the cross member 158 with the apron 134 in front of and in close proximity to or in contact with the cross member.

The sink 100 may be installed by applying, in the form of bead or layer, for example, adhesive and/or sealant material to the top of the cabinet panels 152, 154, 156, 158. After the sealant material is applied to the cabinet 140, then the sink mounting flanges 118, 120, 122, 124 are positioned on the adhesive and/or sealant material. The adhesive/sealant material may be a conventional silicone based material.

After the sink 100 is fitted atop the cabinet 140, an application adhesive/sealant material is applied to the right side mounting flange portion 120 and the left side mounting flange portion 122 and the countertops 146, 148 are fitted to respective first side cabinet and second side cabinets 142, 144. The countertops 146, 148 overlap the right side mounting flange portion 120 and the left side mounting flange portion 122 and the weight of the countertops 146, 146, in combination with the adhesive/sealant material secure the sink 100 atop the cabinet 140 without the need for any other fasteners, clips, hardware or modifications to the countertops, cabinets or sink. Thus, a substantial time and material savings can be realized.

Figure 8:
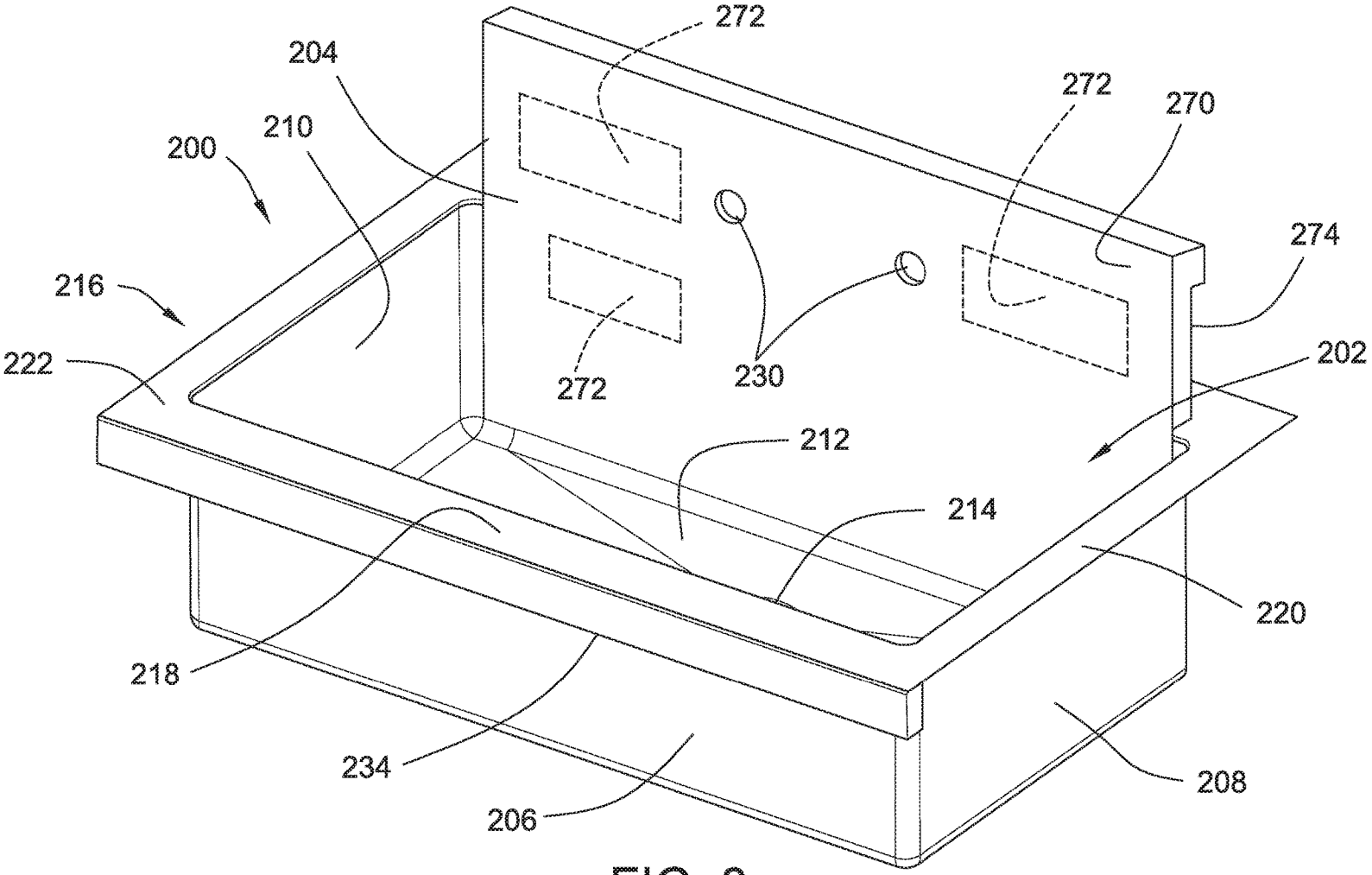
FIG. 8 is a perspective view of a sink according to another embodiment of the disclosure.
Figure 10:
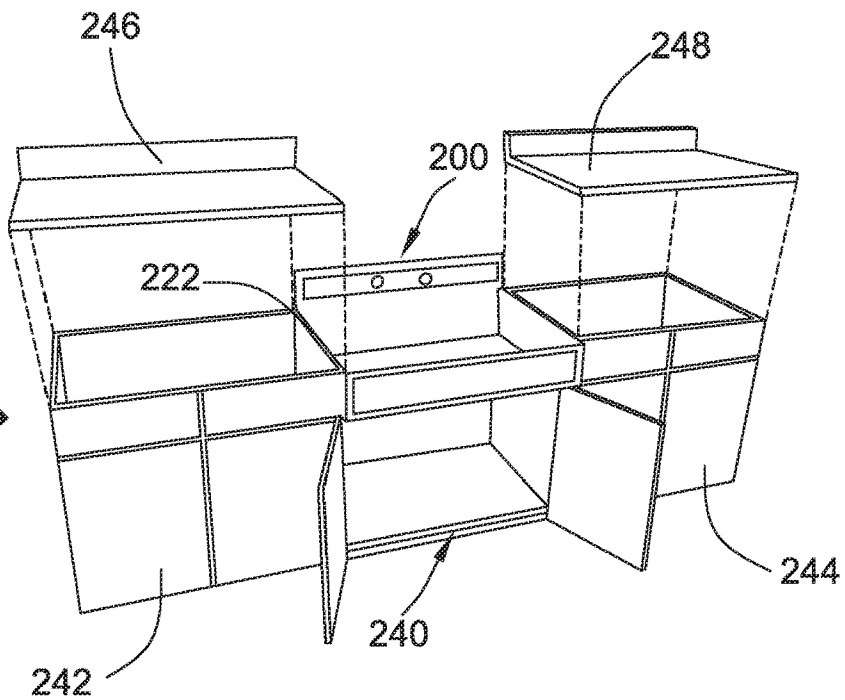
FIG. 10 is a partially exploded perspective view of a set of cabinets and the clipless undermount sink with an integrated backsplash according to the embodiment of FIG. 8 with the sink in an installed state.
Figure 9:
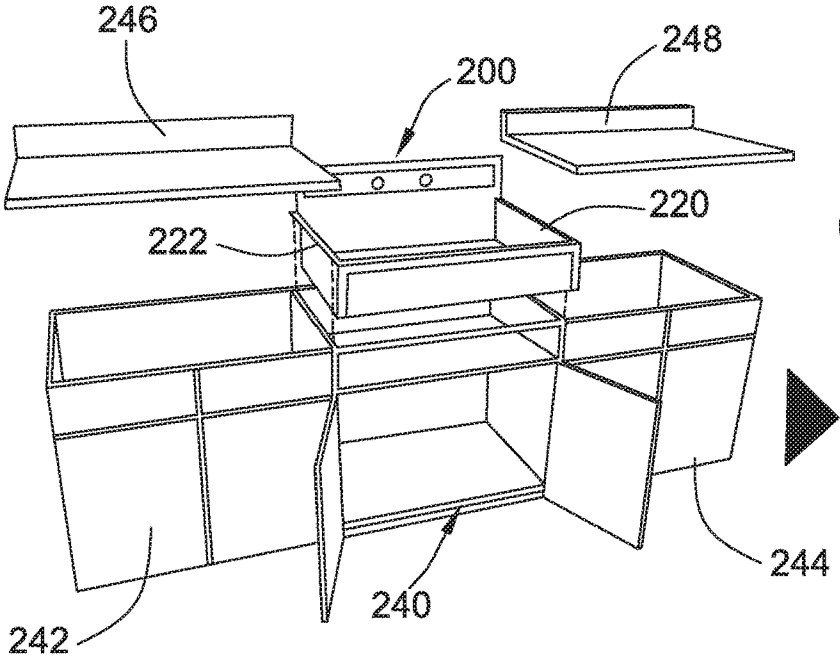
FIG. 9 is an exploded perspective view of a set of cabinets and the clipless undermount sink with an integrated backsplash according to the embodiment of FIG. 8, and countertops.

Another embodiment of a sink 200 according to the disclosure is shown in FIGS. 8-10. The sink 100 may be of any suitable material. The material of the sink 200 may be stainless steel, for example, for its strength, durability, and modern appearance. The sink 200 may formed as a single piece construction. In one embodiment, the sink 200 is formed from a single piece of material, e.g. a single sheet of stainless steel, or in another embodiment, from several pieces of permanently joined material.

The sink 200 includes a basin 202. The basin 202 is sized and shaped to perform typical kitchen duties therewithin, such as washing dishes, and so on. The basin 202 may include a back wall portion 204, a front wall portion 206, a right side wall portion 208 and a left side wall portion 210. The back wall portion 204, front wall portion 206, and the right and left side wall portions 208, 210 may be planar, curved or combinations of flat and curved shapes as is well known. The back wall portion 204 differs from the above embodiment, in that the back wall portion extends upwardly to form a backsplash 270. The backsplash 270 may be in the form of a planar extension of the back wall portion 204. The backsplash 270 may include at least one opening 230 for receiving plumping for installation of a faucet (not shown).

Further, the backsplash 270 may include optional magnetic elements 272, including a material to which magnets will magnetically attach. In one embodiment, the magnetic elements 272 are sheets of ferromagnetic material positioned and attached to the back side 274 of the backsplash 270.

In certain embodiments, the sink 200 can be constructed of a non-ferromagnetic material such that a magnet cannot be attached directly to a surface of the sink. In such embodiments, such as non-ferromagnetic stainless steel sinks or porcelain sinks, the ferromagnetic element 272 can be attached to the sink 200 to attract a magnet to the sidewalls 204, 206, 208, 210 and/or backsplash 270 of the sink. As shown in FIG. 8, one or more non-magnetized ferromagnetic sink elements 272 can be adhered or otherwise secured to exterior back surface 274 of the sink basin 202. The ferromagnetic sink elements 272 can be secured to the basin 202 near one or more of the sidewalls 204, 206, 208, 210 of the sink basin 202. As will be appreciated from the following description, the ferromagnetic sink elements 272 can be secured to the basin 202 of the sink 200 using adhesives, elastic or spring mechanisms, or in any other suitable manner. In addition, any suitable number of ferromagnetic sink elements 272 may be disposed in any suitable position on or near the sink basin 202. In some embodiments, the ferromagnetic sink elements 272 can cover all or substantially all of the exterior of the sink basin 202. By utilizing a non-magnetized ferromagnetic material instead of a magnet as part of the ferromagnetic sink elements 272, inadvertent attachment of ferromagnetic objects to the sink 200 is avoided. During service, a magnetic attractive force between a magnet in an accessory placed within the sink basin 202, and the non-magnetized ferromagnetic sink element, which magnetic force extends through the material of the sink basin and other material layers or coatings applied to the sink 200 can be used to retain an accessory in place within the sink basin. For example, materials that may be coated on the sink side or bottom wall portions can include foams for insulation and/or other materials having a smooth or rough texture. It is contemplated that the ferromagnetic sink elements 272 can be any suitable material of any suitable shape and size depending on the sink metal thickness, the size of the corresponding magnets, and the amount of weight the ferromagnetic sink elements 272 must hold for a given application. When the ferromagnetic sink elements 272 are positioned on the backsplash 270, an accessory (see FIG. 11) can be stored in a position over the basin 202, and draining into the basin and in where it will not interfere with or impede use of the basin for washing and other duties.

The basin 202 also includes a bottom portion 212 that extends to all of the side wall portions 204, 206, 208, 210 and closes the basin 202. The bottom portion 212 is shaped to drain to a drain opening 214, typically formed in a lowermost elevational position within the basin 202.

The sink 200 includes a mounting flange 216 that may surround the basin 202 at or near an uppermost elevational position of the basin. The mounting flange 216 may partially surround the basin 202. The mounting flange 216 extends substantially horizontally from the basin 202 and is sized and shaped to overlap with and be supported by structural members of a cabinet in essentially the same manner as the above embodiment, in which it is installed.

The mounting flange 216 includes a front mounting flange portion 218, a right side mounting flange portion 220, and a left side mounting flange portion 222. The mounting flange 216 may extend horizontally outwardly about ¾ inches or more from the side wall portions 204, 206, 208, 210. The mounting flange 216 is sized and shaped to be received atop the structural panels of a cabinet in essentially the same manner as the above embodiment. The sink 200 may include an apron 234. The apron 234 depends from edge of the front mounting flange portion 218 as in the above embodiment.

The sink 200 is installed into a cabinet in the same manner as in the above embodiment. However, the backsplash 270 may be configured to be mounted with the backsplash positioned flush or nearly flush to an adjacent surface.

Figure 11:
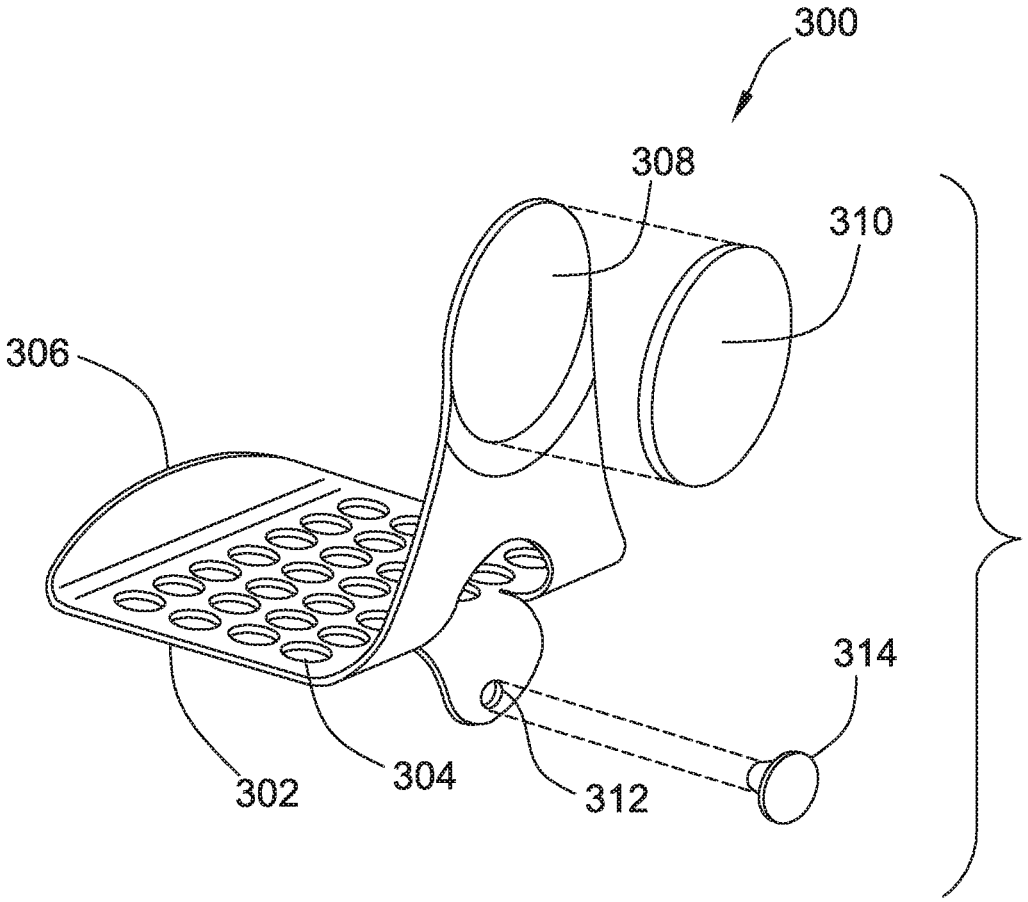
FIG. 11 is a perspective view of an accessory that is usable with embodiments of the disclosure.

FIG. 11 shows an accessory 300 in the form of a small shelf for a bar of soap or other suitable object. The accessory 300 can include a platform 302 for supporting a bar of soap or other object. The platform 302 can include a plurality of apertures 304 to permit water to drain therethrough. The platform 302 can have a raised lip 306 to prevent an object from sliding off the platform at the lip. The accessory 300 can include an attachment portion 308 constructed with a non-magnetized ferromagnetic material. The attachment portion 308 can be shaped to receive a magnet 310. The magnet 310 magnetically attaches the accessory 300 to the ferromagnetic material of the ferromagnetic sink element 272 of the sink 200 by virtue of the magnetic attraction between the magnet 310 and the ferromagnetic sink element 272, to retain the accessory to the sink basin 202. The accessory 300 can include one or more openings 312 to receive one or more pins 314. The pin 314 can space the edge of the accessory 300 from the backsplash 270 of the sink 200 to make the accessory generally parallel to the backsplash 270 and to avoid direct contact between the accessory 300 and the sink 200, which might scratch the sink. The pin 314 can be rubber or another suitably soft material to avoid scratching the sink 200. The pin 314 can also provide a frictional force against the backsplash 270 to increase the weight capacity of the accessory 300.

Referring to FIGS. 9 and 10, the sink 200 is installed according to the same method as in the above example. Accordingly, the sink 200 is installed by applying, in the form of bead or layer, for example, adhesive and/or sealant material to the top of the cabinet 240. After the sealant material is applied to the cabinet 240, then the sink 200 is positioned on the adhesive and/or sealant material. The adhesive/sealant material may be a conventional silicone based material.

After the sink 200 is fitted atop the cabinet 240, an application adhesive/sealant material is applied to the right side mounting flange portion 220 and the left side mounting flange portion 222 and the countertops 246, 248 are fitted to respective first side cabinet and second side cabinets 242, 244. The countertops 246, 248 overlap the right side mounting flange portion 220 and the left side mounting flange portion 222 and the weight of the countertops, in combination with the adhesive/sealant material, secure the sink 200 atop the cabinet 240 without the need for any other fasteners, clips, hardware or modifications to the countertops, cabinets or sink. Thus, a substantial time and material savings can be realized from the method of mounting a sink according to embodiments presented herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An undermount sink and countertop combination for use with a sink cabinet, the sink cabinet including a sink-receiving opening and a sink cabinet width and depth, the sink comprising:

a basin sized and shaped to be received within the sink-receiving opening, the basin including side wall portions, an upper outer perimeter surrounding the side wall portions, and a bottom portion; and a mounting flange extending from the upper outer perimeter of the basin, the mounting flange shaped to rest atop the cabinet and underneath the countertop and sized with a mounting flange width and depth substantially equal to the sink cabinet width and depth;

wherein the basin is sized and shaped to fill the entire sink-receiving opening.

2. The undermount sink and countertop combination of claim 1, wherein the countertop includes a first side cabinet countertop and a second side cabinet countertop, and wherein the mounting flange includes a left side flange portion and a right side flange portion, wherein a portion of the first side cabinet countertop is positioned over the left side flange portion and a portion of the second side cabinet countertop is positioned over the right side flange portion.

3. The undermount sink and countertop combination of claim 2, wherein the side wall portions include a left side wall portion and a right side wall portion and wherein the first side cabinet countertop terminates at or near the left side wall portion and the second side cabinet countertop terminates at or near the right side wall portion.

4. The undermount sink and countertop combination of claim 1, wherein the mounting flange includes a front flange portion, and the side wall portions include a front wall portion, and further comprising an apron depending from the front flange portion and spaced from the front wall portion.

5. The undermount sink and countertop combination of claim 4, wherein the apron has a width that is equal to the sink cabinet width.

6. The undermount sink and countertop combination of claim 5, wherein the space between the apron and the front wall portion is sized and shaped to receive a cross member disposed at a front of the sink cabinet.

7. The undermount sink and countertop combination of claim 1, wherein the mounting flange is planar.

8. The undermount sink and countertop combination of claim 7, wherein the mounting flange fits flush to a top of the sink cabinet.

9. The undermount sink and countertop combination of claim 8, wherein the countertop fits flush to a top of the mounting flange.

10. The undermount sink and countertop combination of claim 9, further comprising an adhesive between the mounting flange and the sink cabinet and an adhesive between the mounting flange and the countertop.

11. The undermount sink and countertop combination of claim 1, further comprising a backsplash.

12. The undermount sink and countertop combination of claim 11, wherein the backsplash extends upwardly from the basin.

13. The undermount sink and countertop combination of claim 11, wherein the backsplash is a planar extension of a back wall portion of the side wall portions of the basin.

14. The undermount sink and countertop combination of claim 11, further comprising at least one magnetic element disposed on one or both of the basin and the backsplash.

15. The undermount sink and countertop combination of claim 14, further comprising an accessory including an attachment portion and a magnet disposed on the attachment portion such that when the attachment portion is placed on the backsplash or in the basin of the sink in the vicinity of the at least one magnetic element, the magnet draws the accessory against the sink due to a magnetic attraction between the magnet and the at least one magnetic element.

* * * * *